US008642877B1

(12) United States Patent
Blish

(10) Patent No.: US 8,642,877 B1
(45) Date of Patent: Feb. 4, 2014

(54) VIBRATION APPLYING ASSEMBLY

(76) Inventor: Jeffrey A. Blish, Los Angeles, CA (US)

( * ) Notice: Subject to any disclaimer, the term of this patent is extended or adjusted under 35 U.S.C. 154(b) by 33 days.

(21) Appl. No.: 13/531,557

(22) Filed: Jun. 24, 2012

(51) Int. Cl.
*G10H 3/00* (2006.01)
*G10D 9/00* (2006.01)

(52) U.S. Cl.
USPC ..... 84/723; 84/453

(58) Field of Classification Search
USPC ..... 84/723, 453
See application file for complete search history.

(56) References Cited

U.S. PATENT DOCUMENTS

| | | | | |
|---|---|---|---|---|
| 2,547,919 | A | 4/1951 | Dalmas | |
| 2,911,872 | A * | 11/1959 | Carl | 84/173 |
| 4,206,678 | A | 6/1980 | Espinos Guerrero | |
| 4,464,967 | A | 8/1984 | Trimborn | |
| 5,031,501 | A * | 7/1991 | Ashworth | 84/723 |
| 5,537,908 | A * | 7/1996 | Rabe et al. | 84/454 |
| 5,600,081 | A * | 2/1997 | Simjian | 84/453 |
| 7,227,068 | B1 * | 6/2007 | Van Doren | 84/297 R |
| 7,678,987 | B2 * | 3/2010 | Lye | 84/723 |
| 7,932,457 | B2 * | 4/2011 | Hall et al. | 84/723 |
| 7,977,555 | B2 * | 7/2011 | Hall et al. | 84/291 |
| 7,977,565 | B1 * | 7/2011 | Lye | 84/723 |
| 8,134,064 | B2 * | 3/2012 | Sanns, Jr. | 84/723 |
| 8,283,551 | B2 * | 10/2012 | Lye | 84/723 |
| 2009/0229445 | A1 * | 9/2009 | Courtright et al. | 84/453 |
| 2009/0293707 | A1 * | 12/2009 | Suhr | 84/723 |
| 2013/0047825 | A1 * | 2/2013 | Kernaghan | 84/723 |

* cited by examiner

*Primary Examiner* — Robert W Horn
(74) *Attorney, Agent, or Firm* — Albert O. Cota

(57) ABSTRACT

A vibration applying assembly (VAA) 10 having a base from where extends a vertical tube having attached to its upper end a hollow forked structure and near its lower end a forked cradle. The structure and the cradle are dimensioned to releasably retain a stringed musical instrument such as an acoustic guitar inserted into the hollow forked structure are a pair of vibrator motors that when energized produce a vibration that permeates through the VAA and an attached acoustic guitar. The applied vibrations provide the means by which an acoustic guitar is pre-maturely aged to enhance the guitar's resonance and the tonal quality.

20 Claims, 8 Drawing Sheets

VIBRATION APPLYING ASSEMBLY

TECHNICAL FIELD

The invention generally pertains to devices that accelerate the aging process of a stringed musical instrument. More particularly, the invention pertains to a vibration applying assembly that accelerates the aging process by applying a constant vibration to the stringed musical instrument.

BACKGROUND ART

Stringed musical instruments, such as acoustic guitars, typically have a neck and a wooden sound box or body that significantly contributes to the tonal quality of and the resonance that is ultimately produced, by the instrument. Guitars that have aged produce an overall tonal quality and resonance that is widely considered to be better, and therefore preferable, to a guitar that has not aged. This is the reason that older, or vintage, instruments are highly sought after by collectors and especially players.

Unfortunately, the aging process for a stringed musical instrument such as a guitar typically takes years to occur. There have been attempts to accelerate the aging process, such as by exposing an instrument to constant light, but these attempts have generally proven to be unsuccessful.

One of the most significant factors that contributes to an instrument's aging is the effect from movements and vibrations on the instrument. Vibrations affect the entire instrument's wood cellular structure, thereby greatly improving the tonal quality and resonance of the instrument. The problem is that the vibrations are only created when the instrument is being handled, which mostly occurs when the instrument is being played. If there was a way by which a stringed musical instrument could experience movement and vibrations, consistently for extended periods, the time required for the aging process to occur, along with the inherent benefits, could be great increased.

A search of the prior art did not disclose any literature or patents that read directly on the claims of the instant invention. However, the following U.S. patents are considered related:

| PAT. NO. | INVENTOR | ISSUED |
|---|---|---|
| US2009/0229445 | Courtright | 17 Sep. 2009 (Published) |
| 7,227,068 | Van Duren | 5 Jun. 2007 |
| 5,537,908 | Rabe | 23 Jun. 1996 |
| 4,464,967 | Trimborn | 14 Aug. 1984 |

The US2009/022945 publication discloses a device for accelerating the conditioning process of a stringed musical instrument by causing the instrument to be continuously strummed and vibrated. The vibrations are transmitted to the wooden body of the instrument, which causes the instrument to prematurely age which over time improves the consistency, richness, and quality of the sound produced by the instrument.

The U.S. Pat. No. 7,227,068 discloses a device for conditioning a stringed musical instrument. The device includes a vibrator mounted on a transverse supporting member which attaches to one or more strings of the instrument. The vibrations produced by the device are transmitted via a mechanical chain from the string to the bridge to the sounding board of the instrument.

The U.S. Pat. No. 5,537,908 discloses a method for improving the sound producing ability of musical instruments by securing some components of the instrument to a supporting surface. The supporting surface is then vibrated at various frequencies across a broad bandwidth for an optimal time. This method may be applied to partially assembled instruments during the manufacturing process, to completed instruments with strings and/or hardware removed, and to fully assembled new and old instruments.

The U.S. Pat. No. 4,464,967 discloses an electrical guitar which includes a pick-up means taking up the swinging movements of the guitar strings and converting them into an electrical signal. The electric signal is amplified and transferred to a loudspeaker fixed to the guitar and an acoustical horn being arranged inside the guitar body. The acoustical horn has an opening facing the loudspeaker.

For background purposes and indicative of the art to which the invention relates, reference may be made to the following remaining patents found in the patent search.

| PAT. NO. | INVENTOR | ISSUED |
|---|---|---|
| US2009/0293707 | Suhr | 3 Dec. 2009 |
| 5,031,501 | Ashworth | 16 Jul. 1991 |
| 4,206,678 | Espinos Guerrero | 10 Jan.1980 |
| 2,911,872 | Carl | 10 Nov. 1959 |
| 2,547,919 | Dalmas | 10 Apr. 1951 |

DISCLOSURE OF THE INVENTION

The vibration applying assembly (VAA), also known as the GUITAR HUMMER™, is designed to provide a means for pre-maturely aging a stringed instrument such as an acoustic guitar. In its basic design, the VAA is comprised of A. A base having an upper surface and a lower surface, B. A vertical tube having an upper end and a lower end, wherein the lower end is attached to the upper surface of the base, C. A hollow forked structure having a first hollow fork, a second hollow fork and a hollow stem that interfaces with the upper end of the vertical tube, D. A forked cradle attached adjacent the lower end of the vertical tube, wherein the hollow forked structure in combination with said forked cradle function to retain the neck and body of the stringed musical instrument, and E. An electrical circuit is connected to an a-c to d-c power supply connected to a utility power source, a first vibrator motor located within the first hollow fork, and a second vibrator motor located within the second hollow fork. The electrical circuit has means for controlling the power applied to the first and second vibrator motors, and the motors each produce a vibration that permeates through said VAA and onto the stringed musical instrument. The vibrations function to accelerate the aging process of the stringed musical instrument.

The base is preferably comprised of a three-legged structure that has a rear facing leg which is shorter than the other front facing legs. The shorter leg allows the vertical tube to slant rearward thereby securely positioning and maintaining an attached acoustic guitar.

The vertical tube, in addition to attaching the hollow forked structure and the forked cradle functions as a conduit for wiring of the electrical circuit. The electrical circuit includes a power switch that controls the application of the power source and a potentiometer that controls the vibration amplitude produced by the first and second vibrator motors.

Additionally, the VAA can also include a set of connectors that are located between the a-c to d-c power supply and the inputs of the power switch and the potentiometers. The connector set facilitates the transport and the set-up of the VAA.

In view of the above disclosure, the primary object of the invention is to produce a VAA that accelerates the aging process of a stringed musical instrument to improve the instrument's tonal quality and resonance.

In addition to the primary object of the invention it is also an object of the invention to produce a VAA that:

is rugged and easy to use, can be designed to accommodate various types and sizes of stringed musical instruments, can be produced in various colors and finishes, can be designed to include vibrator motors that are specifically selected for a particular stringed musical instrument, can be used by either professional or recreational musicians, does not damage the stringed musical instrument, can be used at home, in a studio or on stage, and is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
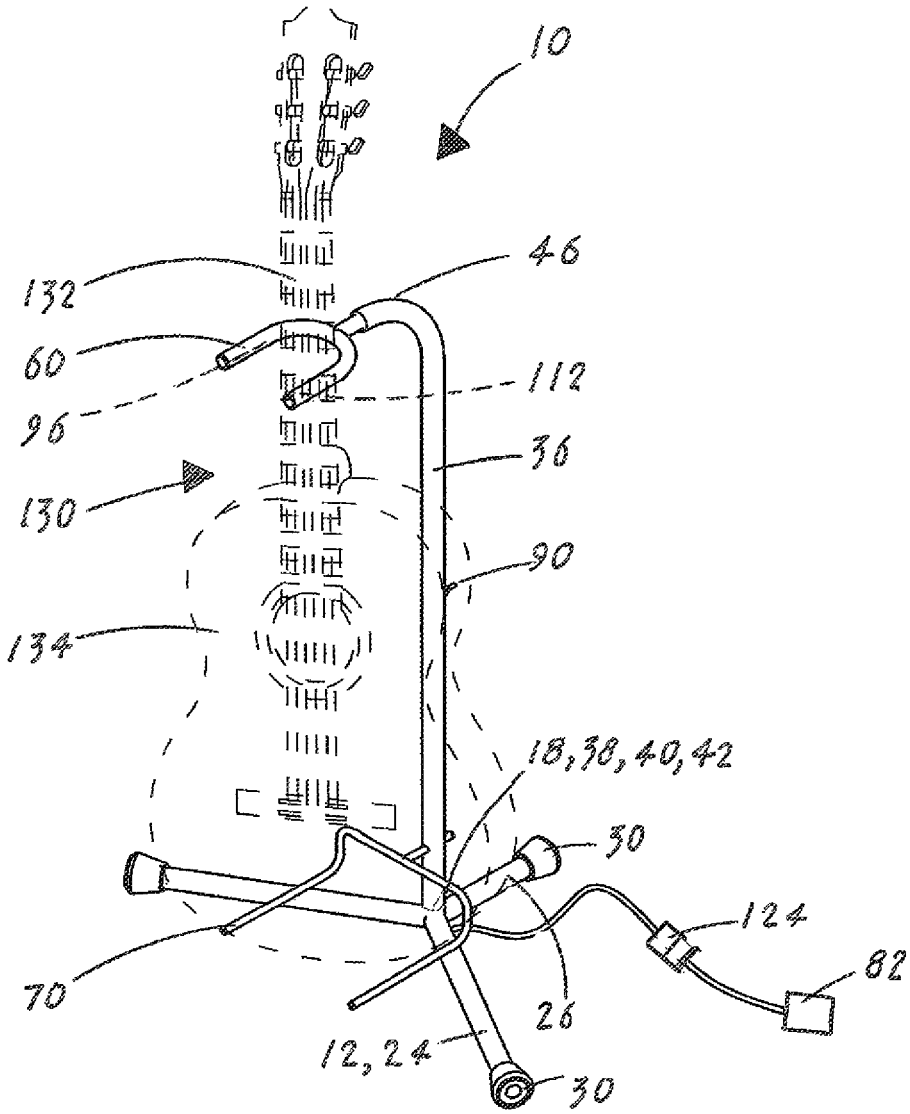
FIG. 1 is a front orthographic view of the vibration applying assembly (VAA) showing an acoustic guitar mounted thereon.

The best mode for carrying out the invention is presented in terms that disclose a preferred embodiment of a vibration applying assembly (VAA). The VAA 10, as shown in FIGS. 1-11, is designed to produce a vibration that is applied to a stringed musical instrument 130 that includes a neck 132 and a body 134. The stringed musical instrument 130 is selected from the group consisting of an acoustic guitar, a violin, a viola, a cello, a mandolin and an ukulele and an acoustic guitar. An acoustic guitar is shown mounted onto the VAA 10 in FIGS. 1 and 5. The applied vibration accelerates the aging process of the stringed musical instrument 130, which improves the resonance and the tonal quality of the instrument 130.

The preferred embodiment of the VAA 10, as shown in FIGS. 1-5, 7 and 8, is comprised of the following major elements: a base 12, a vertical tube 36, a hollow forked structure 60, a forked cradle 70 and an electrical circuit 80. All the major elements of the VAA 10, with the exception of the electrical circuit 80, are selected from the group of materials consisting of metal, plastic and a fiber composite.

Figure 5:
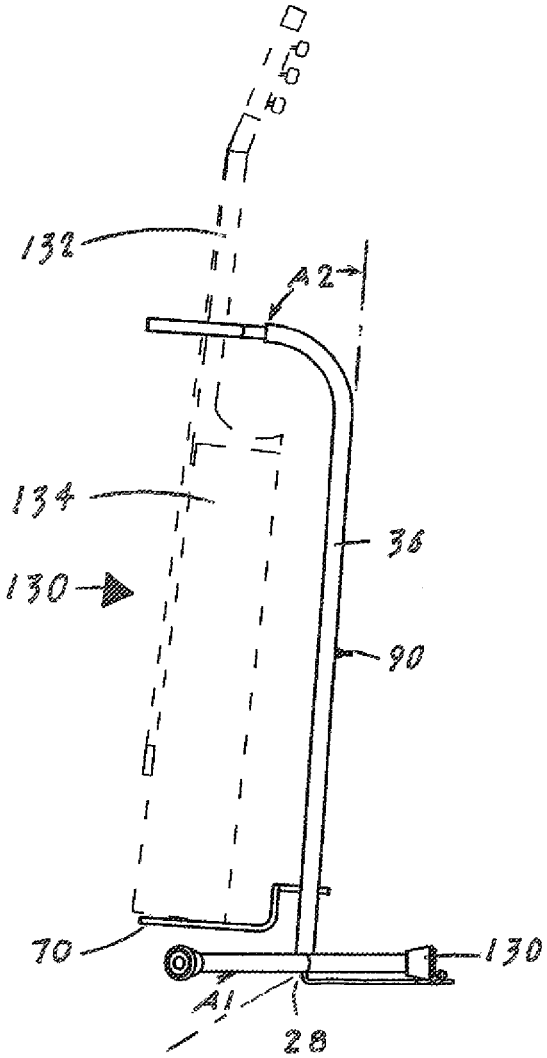
FIG. 5 is a side elevational view thereof showing an acoustic guitar mounted thereon.
Figure 9:
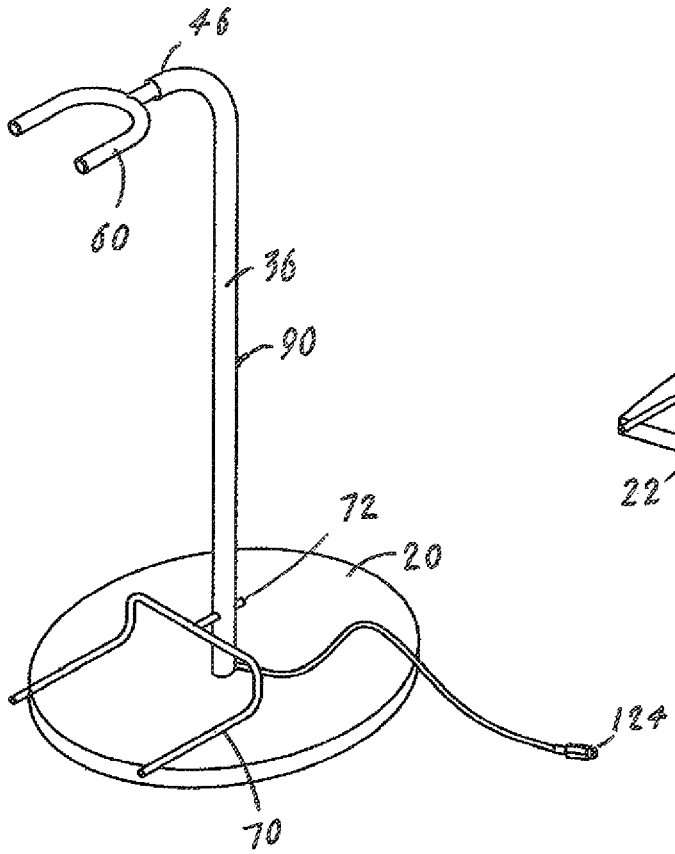
FIG. 9 is a front orthographic view showing a VAA having a circular base.
Figure 10:
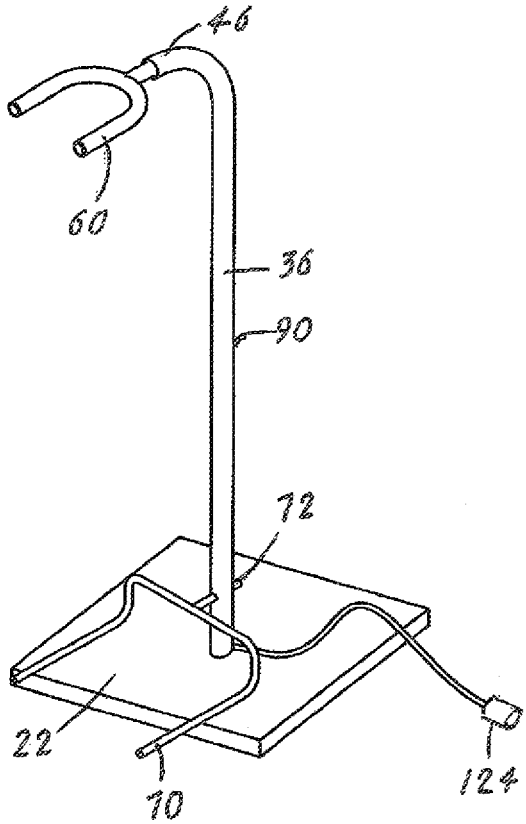
FIG. 10 is a front orthographic view showing a VAA having a square base.

The base 12, as shown in FIGS. 1-4, has an upper surface 14, a lower surface 16 and a vertical tube bore 18. The base 12 can be selected from the group of shapes consisting of a round shape 20, as shown in FIG. 9, a square shape 22, as shown in FIG. 10, and a preferred three-legged shape 24, as shown best in FIGS. 1 and 2. The round shaped base 20 and the square shaped base 22 each have attached to their lower surface an edge pad 32 that produces a vertical space 28. The three-legged shape 24, as shown in FIG. 5, has a rear facing leg 26 that has a shorter length than the other two legs, which allows the VAA 10 to slant rearward at an angle A1 ranging from 5 to 15 degrees. Also, inserted into the terminus of each of the three legs is a resilient insert 30 that cushions and stabilizes the VAA 10. Additionally, all three of the legs angle downward from their inward attachment point to allow a vertical space 28 to be located between the legs and a horizontal plane.

Figure 2:
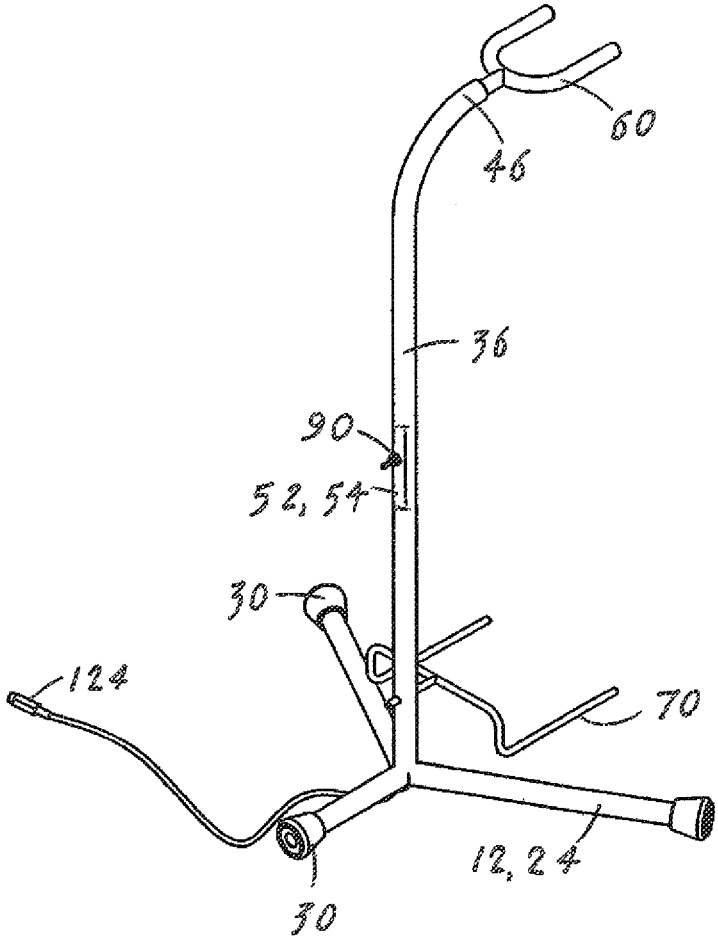
FIG. 2 is a rear orthographic view thereof.
Figure 4:
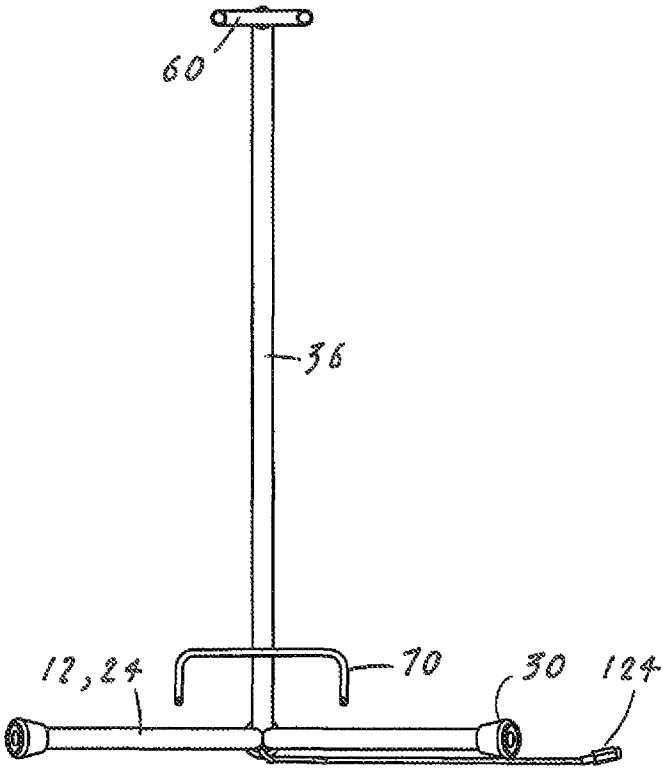
FIG. 4 is a front elevational view thereof.
Figure 6:
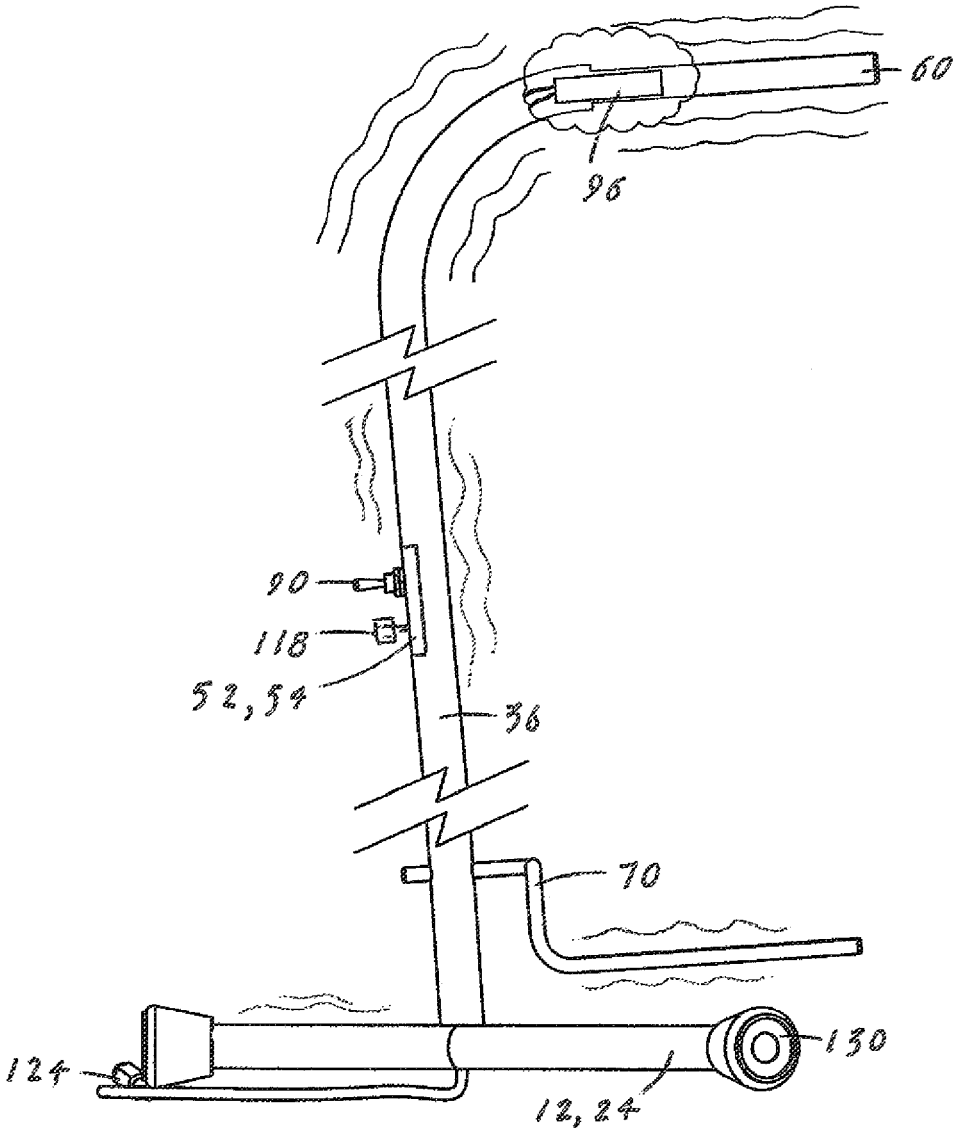
FIG. 6 is a left side elevational view showing a vibrator motor producing vibrations that are applied to the structural elements of the VAA and onto the stringed musical instrument

The vertical tube 36, as shown in FIGS. 1-4, is comprised of a lower end 38, a first side bore 44, an upper curved end 46, a second side bore 48 and an elongated side opening 52. The lower end 38 of the vertical tube 36 is attached over the vertical tube bore 18 that is located on the base 12 by an attachment means 40 that preferably consists of a welding process 42. The first side bore 44 is located above the lower end 38 of the vertical tube 36. The second side bore 48 is located adjacent the upper curved end 46 of the vertical tube 36. The upper curved end 46, as shown best in FIG. 6, curves inward and terminates at an angle A2, as shown in FIG. 5, that ranges from 88 to 92 degrees as measured from a horizontal line. The elongated side opening 52, as shown in FIGS. 2 and 6, faces outward to provide access and to guide the wiring of an electrical circuit 80 as described below. A cover 54 that encloses the elongted side opening 52 is removably attached thereto by a set of metal screws 59. The cover 54 includes a switch bore 56 and a potentiometer bore 58 that are used to respectfully attach a power switch 90 and a potentiometer 118 which are elements of the electrical circuit 80.

The hollow forked structure 60, as shown best in FIGS. 6, 9 and 10, is comprised of a first hollow fork 62, a second hollow fork 64 and a centered hollow stem 66. The hollow stem 66 slidably traverses the upper curved end 46 of the vertical tube 36. When the hollow forked structure 60 is optimally extended, a set screw 68, as shown in FIG. 6, is inserted into the second side bore 48 to lock the hollow stem 66. The hollow forked structure 60 is dimensioned to releasably retain the neck 132 of the stringed instrument 130.

Figure 7:
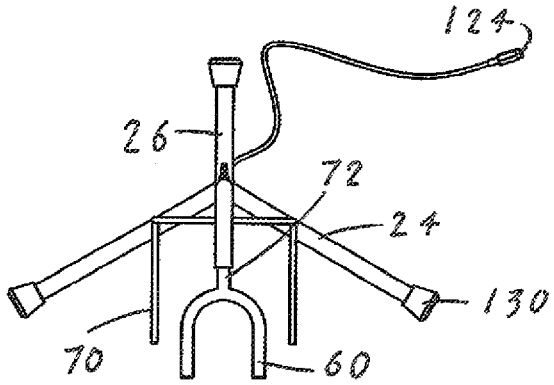
FIG. 7 is a top plan view thereof.
Figure 8:
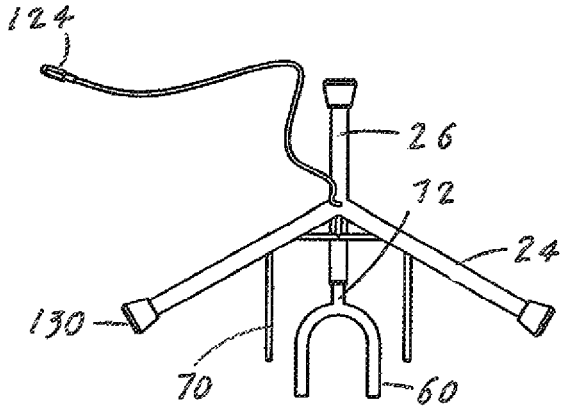
FIG. 8 is a bottom plan view thereof.

The forked cradle 70, as shown in FIGS. 1, 7 and 8, has a horizontal stem 72 that slidably traverses the first side bore 44 located on the vertical tube 36. The forked cradle 70 is dimensional to releasably support the body 134 of the stringed instrument 130.

Figure 11:
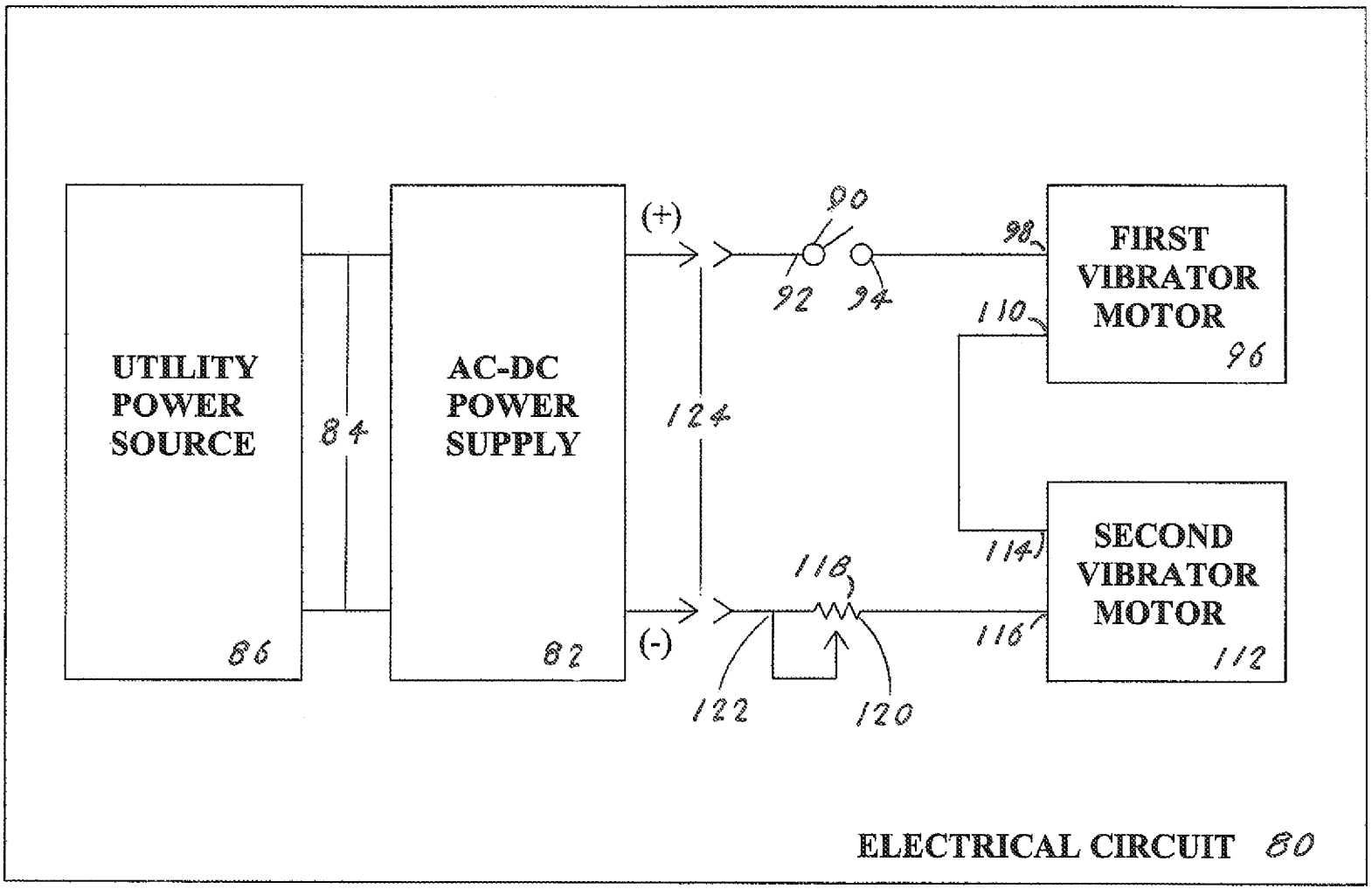
FIG. 11 is a block diagram of the electrical circuit.

The electrical circuit 80, as shown in FIG. 11, is basically comprised of an a-c to d-c power supply 82, a power switch 90, a first vibrator motor 96 and a second vibrator motor 112.

The a-c to d-c power supply 82 has an input 84 that is connected to a utility 120-volt a-c power source 86 and an output consisting of 3.3 volts d-c that is taken across a positive (+) line and a negative (−) line. The power switch 90, which is attached to the switch bore 56 located on the cover 54, also includes a potentiometer bore 58.

The first vibrator motor 96 is inserted into the first hollow fork 62, and has an input 98 and an output 110, wherein the input 98 is connected to the output 94 of the power switch 90. Likewise, the second vibrator motor 112 is inserted into the second hollow fork 64, and has an input 114 and an output 116. The input 114 is connected to the output 110 on the first vibrator motor 96 and the output 116 is connected to the negative (−) line on the power source 86. When the power switch 90 is placed in an ON position, the vibrations produced by the first vibrator motor 96 and the second vibrator motor 112 permeate through the structural element(s) of the VAA 10 and onto the neck 132 and the body 134 of the stringed instrument 130. The first vibrator motor 96 and the second vibrator motor 112 are each preferably comprised of a 304-108 4 mm vibrator motor that is produced by Precision Microdriver Limited U.S.A.

Figure 3:
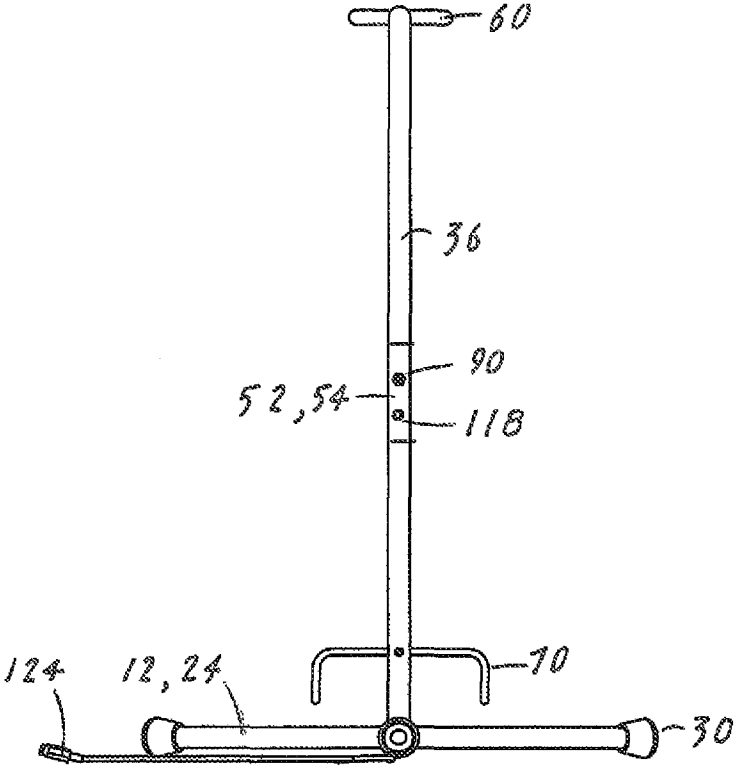
FIG. 3 is a rear elevational view thereof.

To further enhance the utility of the invention, the electrical circuit 80 can also be designed to include a potentiometer 118 and a connector set 124, as shown in FIGS. 3, 6 and 11. The potentiometer 118, which is inserted into the potentiometer bore 58 located on the cover 54, has an input 120 and an output 122. The input 120 is connected to the output 116 of the second vibrator motor 112 and the output 122 is connected to the negative (−) d-c line on the a-c to d-c power supply 82. The potentiometer 118 is designed to control the amplitude of the vibrations that are produced by the first and second vibrator motors 96, 112.

The connector set 124, as shown in FIGS. 1 and 11, is comprised of a male and female 3.5 mm mini-jack, that is located between the (+) and (−) outputs of the a-c to d-c power supply 82 and the input 92 of the power switch 90 and the output 122 of the potentiometer 118. The connector set 124 facilitates the transport and the set-up of the VAA 10.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A vibration applying assembly (VAA) that functions in combination with a stringed musical instrument having a neck and a body, said VAA comprising:

a) a base having an upper surface and a lower surface, b) a vertical tube having an upper end and a lower end, wherein the lower end is attached to the upper surface of said base, c) a hollow forked structure having a first hollow fork, a second hollow fork and a hollow stem that interfaces with the upper end of said vertical tube, d) a forked cradle attached adjacent the lower end of said vertical tube, wherein said hollow forked structure in combination with said forked cradle function to retain the neck and body of the stringed musical instrument, and e) an electrical circuit having an a-c to d-c power supply that is connected to a utility power source, a first vibrator motor located within the first hollow fork, and a second vibrator motor located within the second hollow fork, wherein said electrical circuit has means for controlling the power applied to said first and second vibrator motors, wherein the pair of vibrator motors each produce a vibration that permeates through said VAA and onto the stringed musical instrument, wherein the vibrations accelerate the aging process of the stringed musical instrument.

2. The VAA as specified in claim 1 wherein said stringed musical instrument is selected from the group consisting of an acoustic guitar, a violin, a viola, a cello, a mandolin and a ukulele.

3. The VAA as specified in claim 1 wherein said base is comprised of a three-legged structure having a rear facing leg that has a shorter length than the other two legs, wherein the shorter length leg allows said vertical tube to slant rearward.

4. The VAA as specified in claim 3 wherein all three of the legs angle downward to form a vertical space between the legs and a horizontal plane.

5. The VAA as specified in claim 1 wherein said means for attaching the lower end of said vertical tube to the area surrounding the vertical tube bore comprises a welding process.

6. The VAA as specified in claim 1 wherein said vertical tube further comprises:

a) an elongated side opening and b) a cover that encloses the elongated side opening and that is removably attached thereto by a pair of metal screws.

7. The VAA as specified in claim 1 wherein said electrical circuit further has:

a) a power switch connected between the a-c to d-c power supply and the first vibrator motor, and b) a potentiometer connected between the a-c to d-c power supply and the second vibrator motor.

8. A vibration applying assembly (VAA) designed to apply a vibration to a stringed musical instrument having a neck and a body, said VAA comprising:

a) a base having an upper surface, a lower surface and a vertical tube bore, b) a vertical tube having:

1) a lower end attached by an attachment means over the vertical tube bore located on said base, 2) a first horizontal side bore located adjacent the lower end of said vertical tube, 3) an upper curved end that is angled inward and terminates at an angle ranging from 88-92 degrees, 4) a second horizontal side bore located adjacent the upper end, 5) an elongated side opening that faces outward, c) a cover that encloses the elongated side opening and that is removably attached thereto by a pair of metal screws, said cover further having a switch bore, d) a hollow forked structure having a first hollow fork, a second hollow fork, and a hollow stem that slidably traverses the upper angled end of said vertical tube, wherein when said hollow forked structure is optimally extended, a set screw is inserted into the second horizontal side bore to lock the hollow stem, wherein said hollow forked structure is dimensioned to removably retain the neck of the stringed instrument, e) a forked cradle having a horizontal stem that slidably traverses into the first horizontal side bore located on said vertical tube, wherein said forked cradle is dimensioned to releasably support the body of the stringed instrument, and f) an electrical circuit comprising:

1) an a-c to d-c power supply having an input connected to a utility 120 volt a-c power source and an output consisting of 3.3 volts d-c taken across a positive (+) line and a negative (−) line, 2) a power switch having an input and an output, wherein input is connected to the (+) line on said d-c power supply, 3) a first vibrator motor inserted into the second hollow fork and having an input and an output, wherein the input is connected to the output of said power switch, 4) a second vibrator motor having an input and an output, wherein the input is connected to the output of said first vibrator motor and the output is connected to the (−) line on said power source, wherein when said power switch is placed in an ON position the vibrations produced by said first and second vibrator motors permeate through the structure of said VAA and onto the stringed musical instrument.

9. The VAA as specified in claim 8 wherein said stringed musical instrument is selected from the group consisting of an acoustic guitar, a violin, a viola, a cello, a mandolin and a ukulele.

10. The VAA as specified in claim 9 wherein the shape of said base is selected from the group of shapes consisting of a round shape, a square shape and a three-legged shape.

11. The VAA as specified in claim 10 wherein said three-legged base has a rear facing leg having a shorter length than the other two legs, wherein the shorter length leg allows the vertical tube to slant rearward and at an angle A1 ranging from 5 to 15 degrees.

12. The VAA as specified in claim 11 wherein all three of the legs angle downward from their inward attachment point to form a vertical space between the legs and a horizontal plane.

13. The VAA as specified in claim 12 wherein each leg comprises a resilient insert that is inserted into the terminus of each leg.

14. The VAA as specified in claim 8 wherein said means for attaching the lower end of said vertical tube to the area surrounding the vertical tube bore comprises a welding process.

15. The VAA as specified in claim 10 wherein said power switch is attached to the switch bore on said cover.

16. The VAA as specified in claim 10 wherein said first vibrator motor and said second vibrator motor are frictionally inserted respectively into the first hollow fork and the second hollow fork located on said hollow forked structure.

17. The VAA as specified in claim 10 wherein said cover that encloses the elongated side opening further comprises a potentiometer bore into which is inserted a potentiometer that controls the vibration amplitude produced by said first and second vibrator motors, wherein the potentiometer is connected in series between the output of said second vibrator motor and the (−) d-c line on said a-c to d-c power supply.

18. The VAA as specified in claim 17 wherein said electrical circuit further comprises an electrical connector set that is located between the output of the a-c to d-c power supply and the input of the power switch and the potentiometer.

19. The VAA as specified in claim 18 wherein said electrical connector set is comprised of a 3.5 mm mini jack.

20. The VAA as specified in claim 18 wherein said first and second vibrator motor is comprised of a 304-108 4 mm vibrator motor produced by Precision Microdriver Limited U.S.A.

* * * * *